US007644708B2

(12) United States Patent
Pittman

(10) Patent No.: US 7,644,708 B2
(45) Date of Patent: Jan. 12, 2010

(54) COMPOUND BOW PRESS WITH ADAPTABLE LIMB END FINGERS

(76) Inventor: Leon Monroe Pittman, 661 Hubert Pittman Rd., Pendergrass, GA (US) 30567

( * ) Notice: Subject to any disclaimer, the term of this patent is extended or adjusted under 35 U.S.C. 154(b) by 0 days.

(21) Appl. No.: 12/346,364

(22) Filed: Dec. 30, 2008

(65) Prior Publication Data

US 2009/0107475 A1 Apr. 30, 2009

Related U.S. Application Data

(63) Continuation-in-part of application No. 11/532,615, filed on Sep. 18, 2006.

(60) Provisional application No. 60/740,119, filed on Nov. 29, 2005.

(51) Int. Cl.
*F41B 5/14* (2006.01)

(52) U.S. Cl. ..... 124/1

(58) Field of Classification Search ..... 124/1, 124/23.1, 25.6, 80, 86
See application file for complete search history.

(56) References Cited

U.S. PATENT DOCUMENTS

| | | | | |
|---|---|---|---|---|
| 97,872 | A * | 12/1869 | Burkhardt | 269/218 |
| 323,955 | A * | 8/1885 | Patten | 269/242 |
| 922,336 | A * | 5/1909 | Rivers | 269/189 |
| 3,055,655 | A | 9/1962 | Chelf | |
| 3,580,459 | A * | 5/1971 | Gage et al. | 228/2.3 |
| 4,415,149 | A * | 11/1983 | Rees | 269/88 |
| 5,022,377 | A | 6/1991 | Stevens | |
| 5,222,473 | A | 6/1993 | Lint | |
| 5,370,103 | A | 12/1994 | Desselle | |
| 5,425,350 | A * | 6/1995 | Egusquiza | 124/86 |
| 5,433,186 | A | 7/1995 | Corwin | |
| 5,746,192 | A | 5/1998 | Gissel | |
| 6,386,190 | B1 | 5/2002 | Kurtz, Jr. | |
| 6,932,070 | B1 | 8/2005 | Kurtz, Jr. | |
| 6,957,647 | B2 | 10/2005 | Evans et al. | |
| 6,968,834 | B1 | 11/2005 | Gibbs | |
| 7,089,923 | B2 * | 8/2006 | Johnson | 124/1 |
| 2006/0000462 | A1 | 1/2006 | Kurtz, Jr. | |
| 2006/0191522 | A1 | 8/2006 | Henry | |

* cited by examiner

*Primary Examiner*—John Ricci
(74) *Attorney, Agent, or Firm*—Mitch Harris, Atty at Law, LLC; Andrew M. Harris

(57) ABSTRACT

A bow maintenance press and method provides operation adaptable to various bow designs using adaptable bow press fingers that apply force to the bow limb ends. The bow limb end fingers may be interchangeable to supply different shapes or sizes and/or may provide adjustment in at least a limb end width or length, such that substantially equal force is applied to the bow limb ends of a bow having at least one split limb end. The fingers may be tiltable to adjust for differing limb end lengths and may be spring-loaded to ease in initial placement and retention of a bow before it is compressed.

22 Claims, 7 Drawing Sheets

COMPOUND BOW PRESS WITH ADAPTABLE LIMB END FINGERS

The present U.S. patent application is a Continuation-in-Part of U.S. patent application Ser. No. 11/532,615 filed on Sep. 18, 2006, the disclosure of which is incorporated herein by reference, and which claims priority under 35 U.S.C. §119(e) to U.S. Provisional Patent Application Ser. No. 60/740,119, filed on Nov. 29, 2005.

BACKGROUND OF THE INVENTION

1. Field of the Invention

The present invention relates generally to bow presses for maintenance of archery bows, and more particularly, to a bow press for maintenance of bows that includes fingers that adapt to ends of split bow limb.

2. Description of the Related Art

Bow presses are used in maintenance of archery bows, and in particular, are necessary for the maintenance of compound bows, where the force required to compress the bow in order to remove the bow string(s) and perform other operations can require hundreds of pounds of force.

The above-incorporated U.S. patent application discloses and claims a compound bow press that contracts a bow by applying a force only from the ends of the bow limbs. Some bows, and compound bows in particular, have split limb ends and various features located at the limb ends that can interfere with the press at the point of force application or make it difficult to uniformly apply a force to the split limb ends of the bow such that the bow does not twist in the press or is damaged due to concentration of force at one point. The limb end features are not uniform as among the bows, and include idler wheels, cams and structural differences that vary from model to model and among bows from different manufacturers.

Therefore, it would be desirable to provide a maintenance bow press, and in particular a press for compound bows, that is adaptable to various bow designs and can apply force to split limb ends of a bow without twisting or applying unduly concentrated forces that may damage the bow.

SUMMARY OF THE INVENTION

The objective of providing a maintenance bow press for compound bows that is adaptable to different bow designs, avoids twisting the bow and avoids unduly concentrating the forces applied to split bow limb ends is provided in a bow press, bow limb end fingers, and a method of operation of the bow press and fingers.

The bow press includes bow limb end fingers that are adaptable to various bow limb end shapes and attachments. The adaptability may be provided by removable and replaceable bow limb fingers having differing profile shapes, and/or by mechanisms that provide for adjusting the position of the fingers with respect to each other. The distance between the fingers in a direction perpendicular to the length of the bow may be adjustable and/or a displacement between the position of the bow limb end contact area of the fingers along the length of the bow, to accommodate bows having a difference in the length of split portions of the bow limb ends. Both width and length adjustment may be provided by a set of fingers having through-holes for insertion over pins in fixture bases attached to the bow press at opposite ends of the bow. By sliding the fingers along the pins, different bow widths (i.e. different distances between the split portions of the limb ends) can be accommodated, and by rotating the finger(s) around the pin, different bow limb end displacements can be accommodated. A thumbscrew may provide adjustment of one or all of the fingers to secure the angle of rotation and the finger(s) may be spring loaded to retain the finger(s) at the angle set by the thumbscrew.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention includes bow presses and fingers that are adaptable to accommodate different bow designs, in particular, differences in the bow limb ends and structures secured at the bow limb ends in order to equalize forces applied to split limb ends of compound bows, to accommodate different widths between the split limb ends and to avoid interference between the limb ends and/or devices attached to the bow limb ends and the press.

Figure 1:
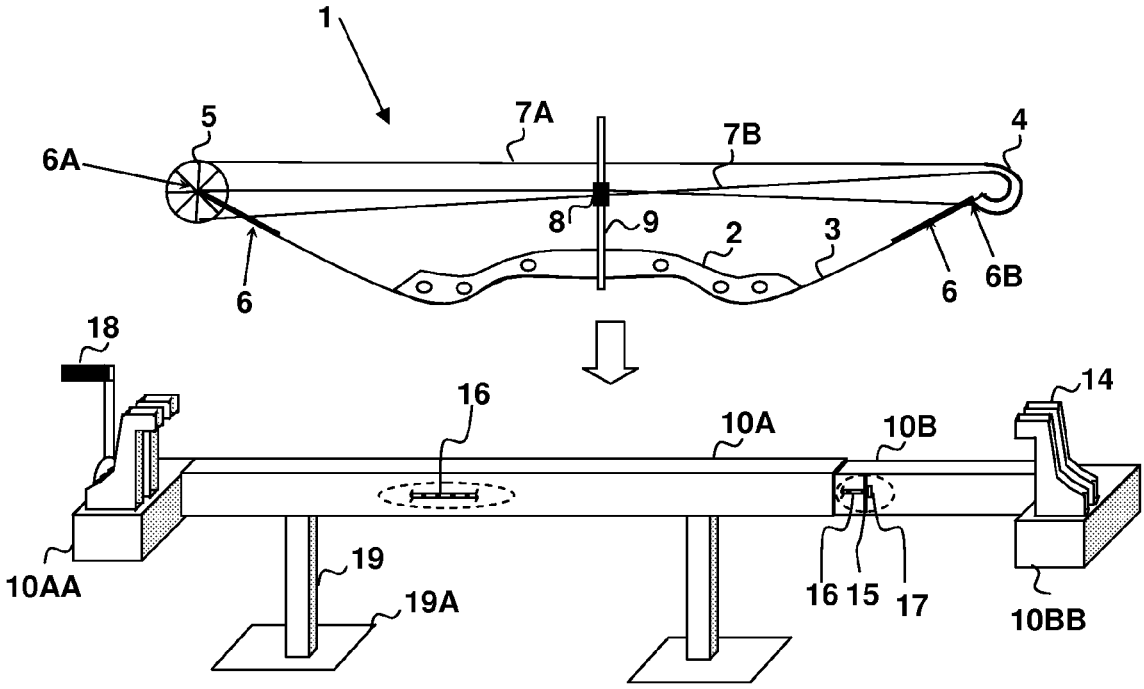
FIG. 1 is an illustration of a bow press in accordance with an embodiment of the invention prepared for receiving a compound bow 1.

Referring now to FIG. 1, a bow press in accordance with an embodiment of the invention is illustrated. In the illustration, the bow press is adjusted to accept insertion of a compound bow 1. Compound bow 1 includes riser 2, and bow limbs 3 that provide the structure of the bow that resists the tension on the bow string 7A and cable 7B. The bow limbs have a reinforced portion 6, which may or may not be split, toward limb ends 6A and 6B that support the idler wheel 5 and cam 4, respectively, which in turn provide the bow string 7A and cable 7B paths. A cable guard 9 provides a path for cable slide 8, which is used to pull and steady bow string 7A and cable 7B.

The illustrated bow press includes a telescoping frame member composed of two sections 10A and 10B, which may be made from extruded steel tube with a square cross section, with section 10B having suitable external dimensions to fit within section 10A and slide within section 10B, while retaining lateral stability. A worm gear 16 is included within sections 10A and 10B and is rotatably affixed to section 10B through an internal flange 15 and a lock nut 17, on the opposing end of section 10A a crank handle 18 is attached to worm gear 16 through a suitable collet (not shown). By turning crank handle 18 the telescoping frame member is expanded or collapsed and is shown in the expanded position for receiving bow 1. Stand legs 19 and flanges 19A are provided for mounting the bow press to a workbench or stand. Holes may be provided through flanges 19A for this purpose and may be patterned to accept through-bolts of a prefabricated stand.

Extension arms 10AA and 10BB of frame members 10A and 10B, respectively, provide for the placement of bow 1 away from the central portion of the bow press, so that bow 1 does not interfere with frame members 10A and 10B as the bow is compressed. A set of bow limb end fixtures 14 is provided on extension arms 10AA and 10BB to retain the bow limb ends of bow 1 in the bow press and may be particularly adapted for different types of bow ends as will be described below in further detail. The only force applied from the depicted bow press to bow 1 is a force applied to the bow limb ends 6A and 6B, with no contact made between the bow press and riser 2 or the portion of bow limbs 3 that is substantially away from bow limb ends 6A and 6B.

Figure 2:
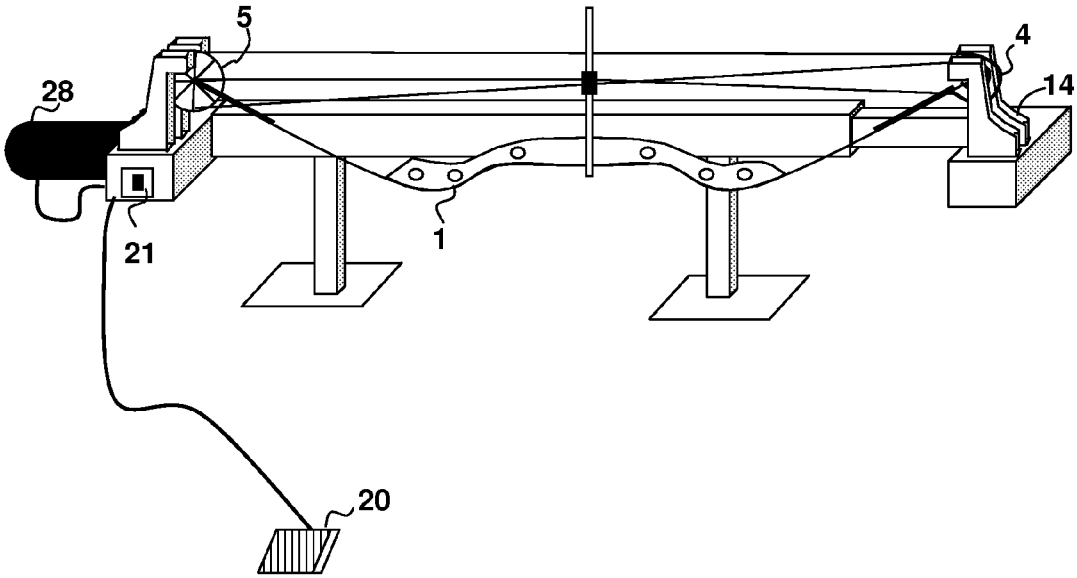
FIG. 2 is a pictorial diagram of a bow press in accordance with another embodiment of the invention, with a compound bow 1 installed.

Referring now to FIG. 2, a bow press in accordance with another embodiment of the present invention is shown, and is also further used to illustrate the operation of the bow presses of both FIGS. 1 and 2 when bow 1 is inserted in one of the bow presses of the present invention. As shown, bow limb end fixtures 14 are located on either side of idler wheel 5 and cam 4, so that idler wheel 5 and cam 4 do not receive any compressive force from the bow press. The depicted embodiment is similar to that of the bow press of FIG. 1 and therefore only differences between them will be described. In particular, FIG. 2 illustrates that when bow 1 is inserted in the bow press, all of the bow press elements lie outside of the primary (convex) curvature of the bow, except for the tips of the bow limb end fixtures 14. Some bows may have multiple curvatures, but the primary curvature includes within it the bulk of the bow string and bow cable, if present. Thus, the primary curvature of bow 1 is the arc along the body of the bow that extends between bow limb end 6A to bow limb end 6B.

In the depicted embodiment, the compressive force is applied by a motor 28 rather than the crank handle 18 of FIG. 1. Motor 28 is operated by a safety cutoff switch 21 as is well known in the state of the art for power tool operations. Cutoff switch 21 can only be activated, in reverse or forward direction, by lifting a cover, but can be deactivated with slight contact, providing safety in operation. A footswitch 20 further provides for hands-off operation of motor 28 once cutoff switch 21 is engaged, so that an operator can control positioning of bow 1 as frame members 10A and 10B are driven together.

To operate the bow press, the operator positions bow 1 in the bow press as shown, and activates switch 21 in the forward (closing) direction until bow 1 is sufficiently compressed to remove cable 7A and bow string 7B. After servicing is complete, switch 21 is activated in the reverse direction, releasing the compression applied to the bow by frame members 10A and 10B, until the bow limb end fixtures 14 are sufficiently separated that bow 1 can be easily removed.

Figure 3:
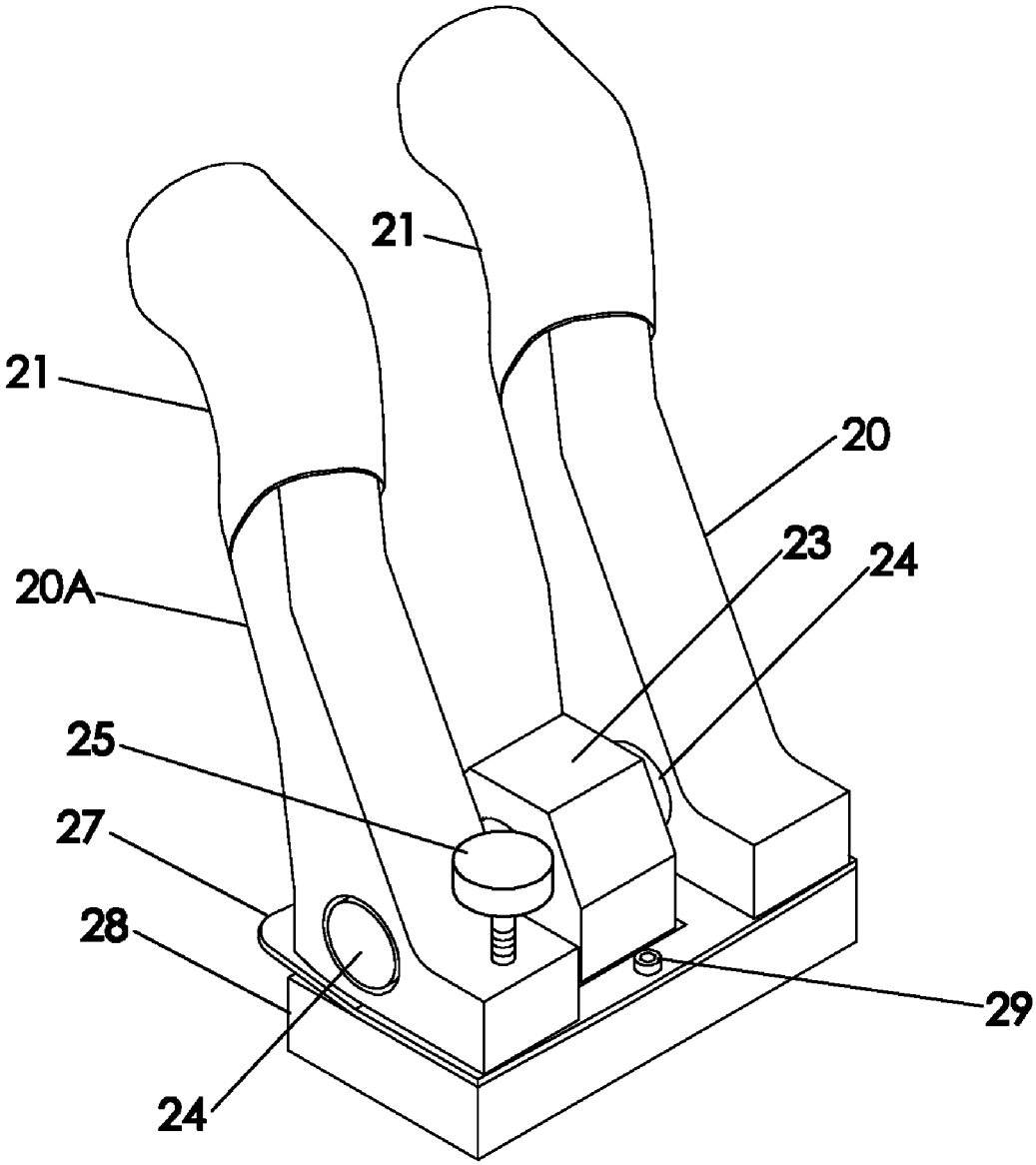
FIG. 3 is an isometric view of a bow limb end fixture, as may be used to implement bow limb end fixtures 14 of FIGS. 1 and 2.

Referring now to FIG. 3, details of bow limb end fixtures 14 are shown in accordance with an embodiment of the present invention. Bow limb end fingers 20 and 20A have partially hooked ends with rubber boots 21 provided over the tips of the fingers to prevent scratching or other damage to bows. Fingers 20 and 20A contact the bow limb ends at contact areas 21, providing secure retention of bow 1 when compressive force is applied by the bow press. Fingers 20 and 20A are secured to fixture base 28 by insertion over a pin, around which at least finger 20A can rotate and slide in a direction perpendicular to the length of a bow inserted in the bow press. A thumbscrew 25 provides for setting an initial rotation of finger 20A, which is the maximum "clockwise" rotation of finger 20A as depicted in the Figure. Pin 24 is secured in fixture base 28 by a riser portion 23. A leaf spring 27 is secured to fixture base 28 by a bolt 29. Leaf spring 27 is compressed when finger 20A is rotated in a counter-clockwise direction, causing finger 20A to assume the maximum clockwise rotation permitted by thumbscrew 25 prior to insertion of a bow, so that finger 20A does not move when a bow is inserted. Control of the rotation of finger 20A provides for adjustment of a displacement in length between the bow limb ends, as will be illustrated in further detail below.

Figure 4:
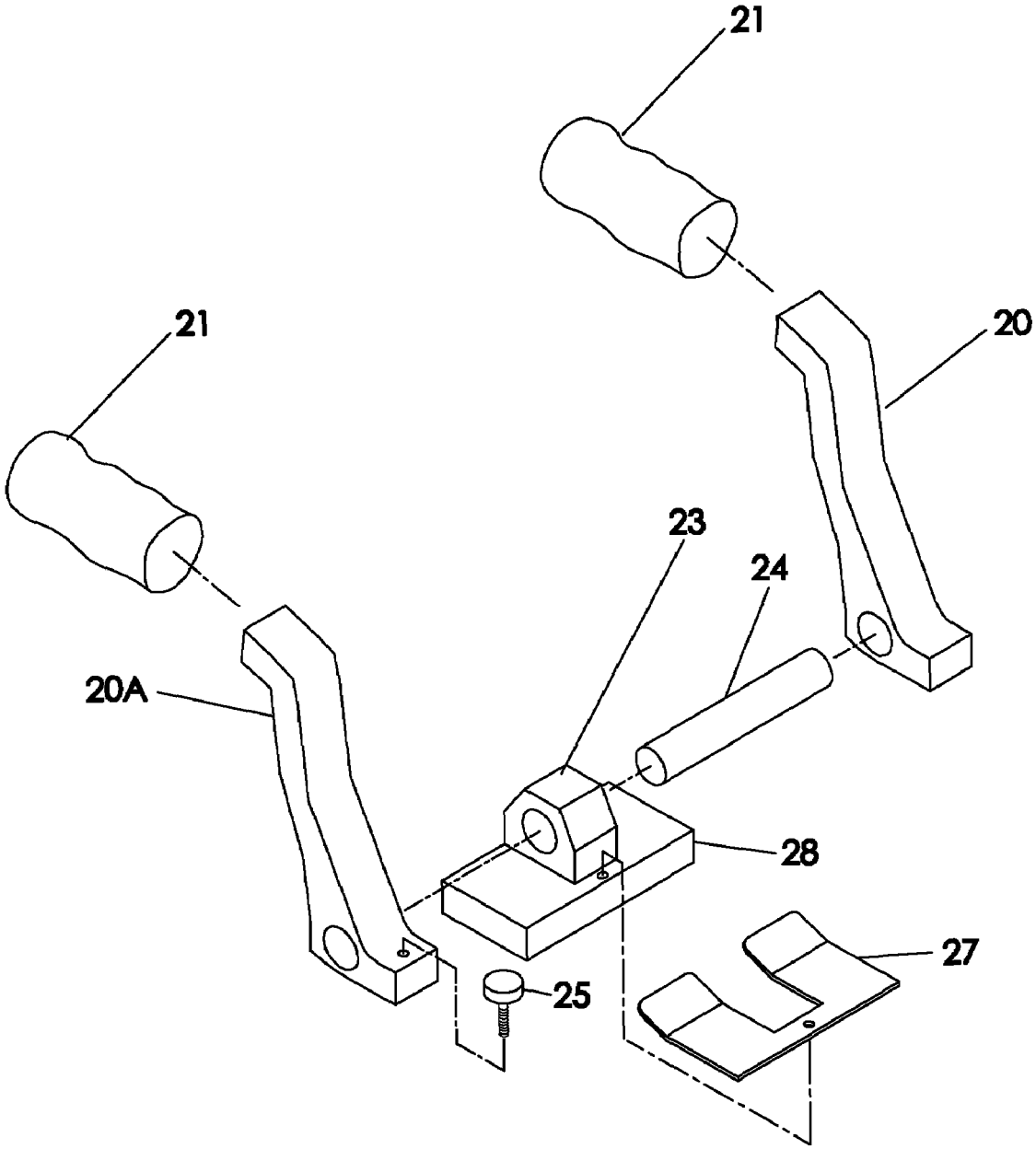
FIG. 4 is an exploded isometric view of the bow limb end fixture of FIG. 3.

Referring now to FIG. 4, details of the assembly of the bow limb end fixture of FIG. 3 are illustrated in an exploded isometric view. Like reference designators refer to like components and the description above is applicable to instant FIG. 4. Pin 24 is secured within riser portion 23 of fixture base 28 by press-fit, adhesive or other suitable permanent retention techniques. The holes within fingers 20A and 20 via which fingers are inserter over pin 24 are tolerance to provide a secure fit, while permitting rotation and sliding of fingers 20 and 20A around and along pin 24. Finger 20 may be provided with a bottom surface such that finger 20 does not rotate, or alternatively rotation of finger 20 may be permitted to a limited degree. At least finger 20A has a surface shaped to permit rotation in the direction of a mounted bow, as will be described in further detail below.

Figure 5A:
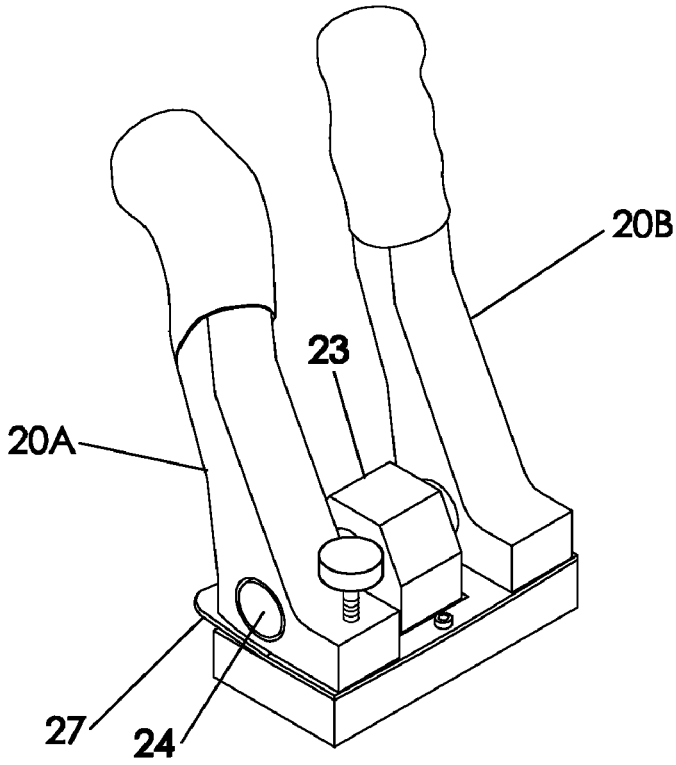
FIGS. 5A and 5B are isometric views of a bow limb end fixture, as may be used to implement bow limb end fixtures 14 of FIGS. 1 and 2, illustrating the width adjustability and interchangeable limb end finger features of bow press fingers in accordance with embodiments of the present invention.
Figure 5B:
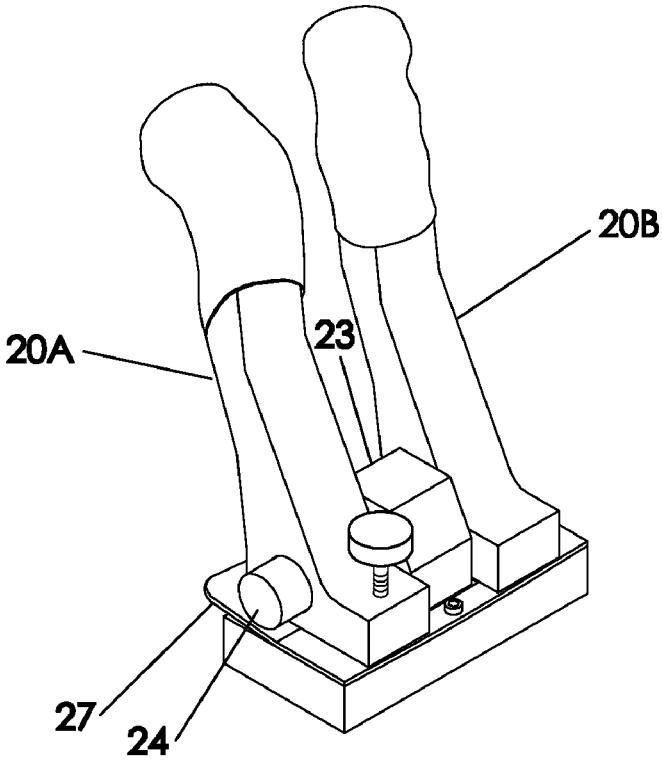

Referring now to FIGS. 5A and 5B, adaptability of bow limb end fixtures 14 to different bow limb end structures and adjustment of a set of fingers 20A and 20B to accommodate bow limb end width are illustrated. First, as illustrated in FIG. 5A, finger 20 of FIG. 3 has been replaced with finger 20B having a different shape, as described in the above-referenced U.S. parent patent application, that has a substantially vertical extension to avoid structures such as cams, etc. that are present on the far side of a bow limb end with respect to the illustration, and that would otherwise be contacted by the tip of finger 20 and receive an excessive application of force when the bow is compressed. Finger 20 is slid off pin 24 and replaced with finger 20B by sliding finger 20B onto pin 24. FIG. 5B illustrates adjustment of the bow limb end fixture of FIG. 5A to accommodate a narrower bow limb end, in which the spacing between the centers of split portions of bow limb ends are closer together. By sliding fingers 20A and 20B inward toward riser portion 23, fingers 20A and 20B are brought closer together to accommodate the narrower bow. Split limb end widths various sizes can thereby be accommodated up to the limits provided by the width of riser portion 23 and the length of pin 24, which can be adapted to a range of bow limb end sizes expected. Leaf spring 27 supplies upward force on the bases of fingers 20A and 20B, preventing fingers 20A and 20B from moving too freely once their position along pin 24 has been set.

Figure 6:
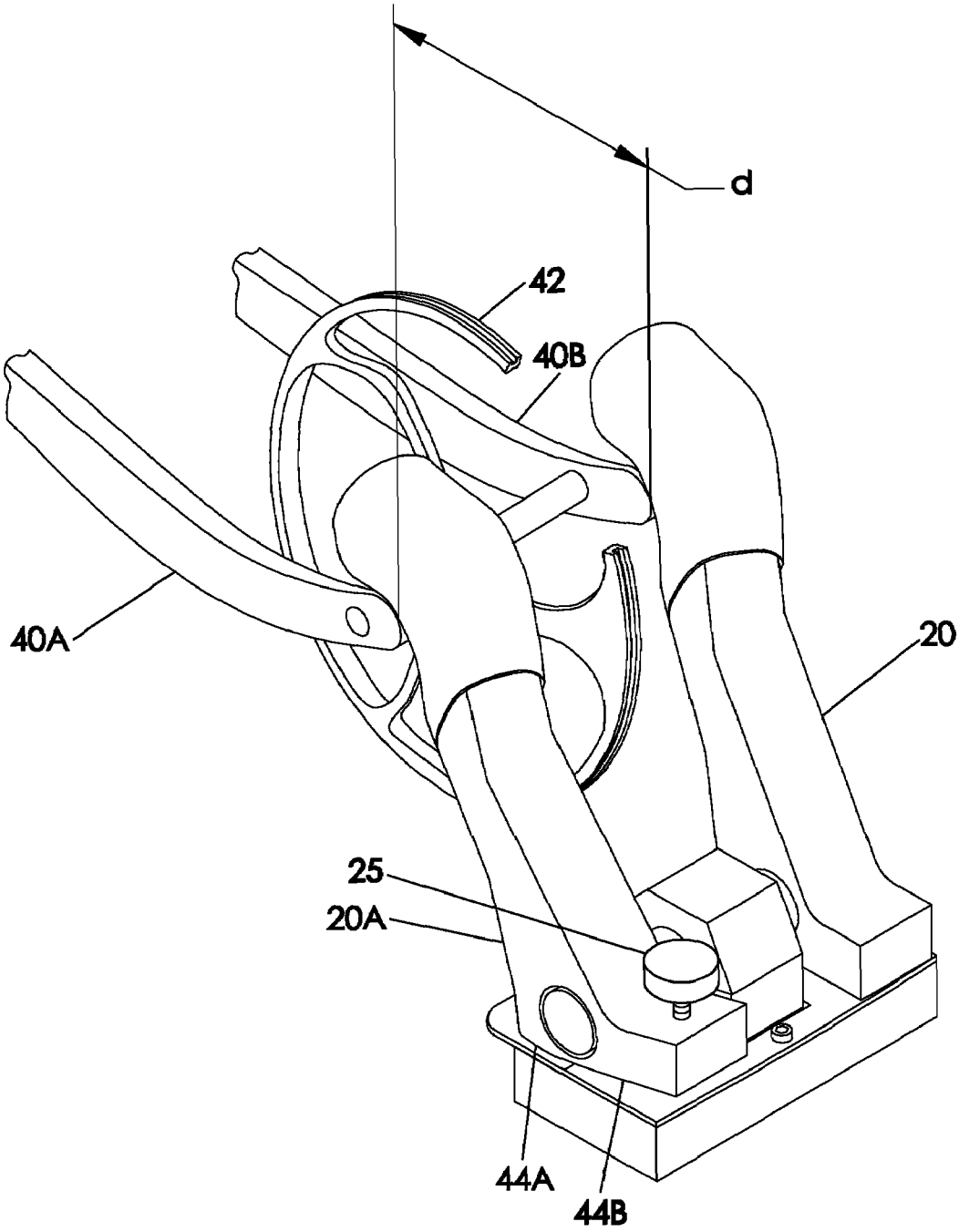
FIG. 6 is an isometric view of a bow limb end fixture, as may be used to implement bow limb end fixtures 14 of FIGS. 1 and 2, illustrating the limb end length adjustability of bow press fingers in accordance with an embodiment of the present invention.

Referring now to FIG. 6, adjustment of fingers 20 and 20A of FIG. 3 is shown to accommodate a displacement d between bow limb ends 40A and 40B along the length of a bow inserted into a bow press. Thumbscrew 25 is adjusted to rotate finger 20A, and the bottom surface of finger 20A is shaped, such that finger 20A is permitted to rotate counter-clockwise, according to the view of the Figure, to offset the contact areas of fingers 20 and 20A by displacement d along the length of the bow. (Idler wheel 42 has been cut-away to enhance visibility of bow limb end 40B) The bottom surface of finger 20A has a flat portion 44B, which is substantially horizontal when thumbscrew 25 is fully relaxed, and a curved or sloped portion 44A that permits finger 20A to rotate counter-clockwise, again according to the view of the Figure, when thumbscrew 25 is tightened. By setting displacement d such that bow limb ends 40A and 40B lightly contact corresponding fingers 20 and 20A before the bow is compressed, when the hand crank or motor of the press is activated, a substantially equal force is applied to each of bow limb ends 40A and 40B, which prevents twisting of the bow in the press that would otherwise occur by compressing longer bow limb end 40B for some distance before finger 20 would contact bow limb end 40A.

Figure 7:
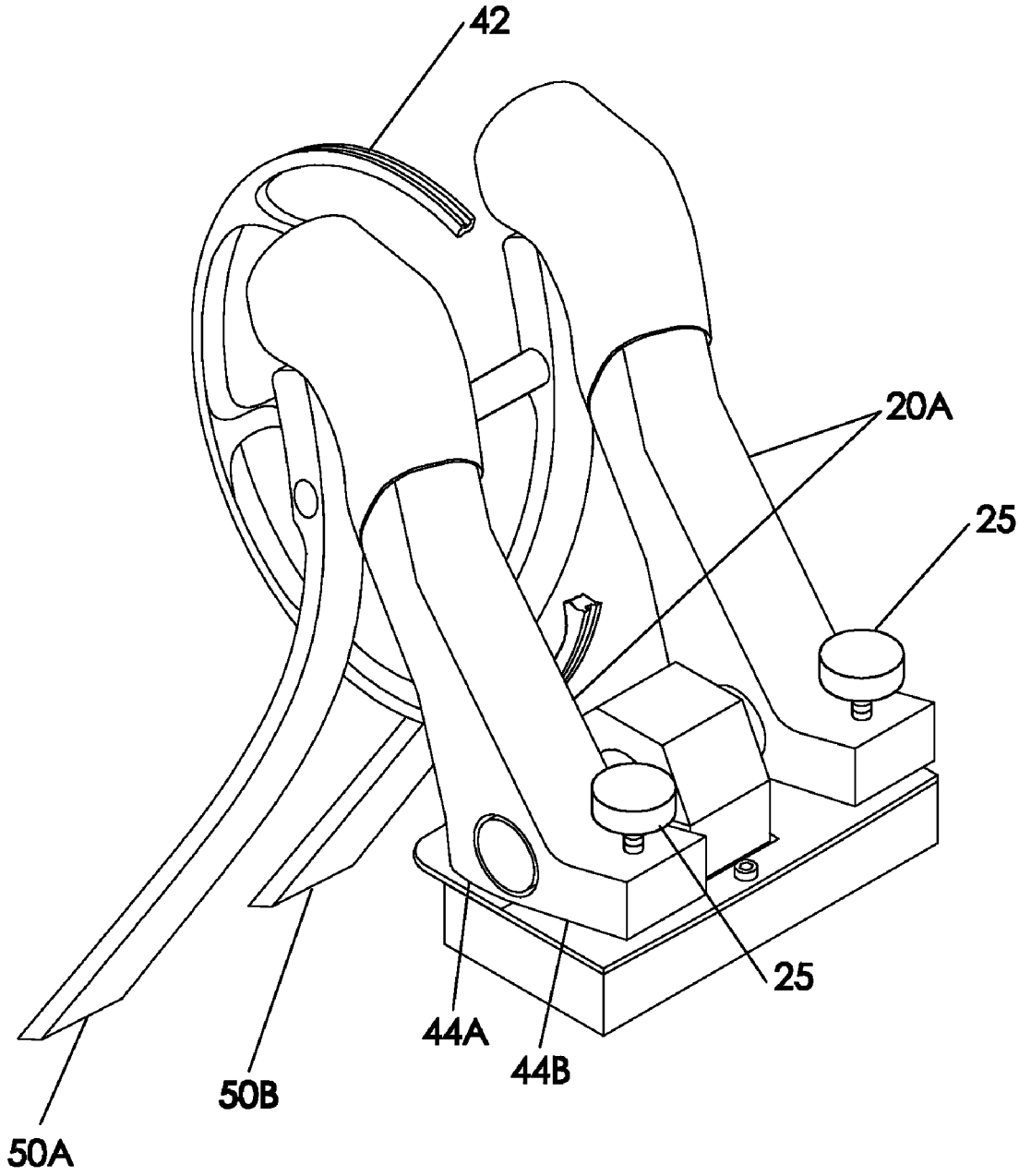
FIG. 7 is an isometric view of a bow limb end fixture, as may be used to implement bow limb end fixtures 14 of FIGS. 1 and 2, illustrating rotational adjustability of both bow press fingers in accordance with an embodiment of the present invention.

Referring now to FIG. 7, a limb end fixture configuration including two rotationally adjustable fingers 20A is shown. Each of fingers 20A includes a thumbscrew 25 and has a curved or angled bottom surface portion as described above. A bow having bow limb ends 50A and 50B on either side of idler wheel 42 (again cut-away to reveal details of bow limb end 50B) is inserted into the bow press. Bow limb ends 50A and 50B extend almost vertically and have a surface that curves toward the limb end fixture of FIG. 7 and then away from fingers 20A, making it difficult to secure bow limb ends 50A and 50B during compression of the bow. Thumbscrews 25 are set to rotate both fingers 20A in a counter-clockwise direction, according to the view of the Figure, so that the hooked tips of fingers 20A are angled to capture the bow limb end. FIG. 7 is further illustrative of another feature of the fingers of FIGS. 3-7, in that the tips of fingers 20A extend in the direction of the length of the bow away from their bottom surfaces and the fixture base due to the angle of the extension of fingers 20A from their base to the region of their tips before the hooked portion commences. Such a shape permits bow limb ends 50A and 50B to extend toward the fixture base, both initially and during compression of the bow, without the bow limb contacting the bow press other than on the protected tips of fingers 20A.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A bow press for servicing an archery bow, comprising:

a frame for securing the archery bow;

an adjustment mechanism for applying force to the limb ends of the bow to compress the bow, wherein the limb ends of the bow include at least one limb end that is split into two portions; and an adaptable finger assembly mechanically coupled to the frame and including a pair of fingers for contacting the split portions of the limb ends of the bow to apply the force, wherein the fingers are adaptable to at least one of a shape of a structure at the at least one limb end, a width between the two portions of the at least one limb end or a length of the portions of the at least one limb end, wherein the portions of the at least one bow limb end have differing extensions in a second direction along the length of the archery bow when the archery bow is mounted in the bow press, and wherein the pair of fingers can be adjusted to accommodate a distance between ends of the differing extensions, such that a first point of contact of a first one of the fingers with an end of a first one of the portions of the at least one bow limb is displaced by the distance in the second direction with respect to a second point of contact between a second one of the portions of the at least one bow limb end and a second one of the fingers.

2. The bow press of claim 1, wherein the fingers include at least one finger that is removable and interchangeable as between a set of limb end fingers having a different shape, whereby interference with the shape of the structure can be avoided by securing a particular one of the set of limb end fingers to the finger assembly.

3. The bow press of claim 2, wherein the finger assembly comprises:

a base secured to the frame; and a pin affixed to the base and extending in a first direction perpendicular to the length of the archery bow when the bow is mounted in the bow press, and wherein the at least one finger includes a hole for insertion over the pin, whereby the at least one finger is rotatably secured to the finger assembly.

4. The bow press of claim 1, wherein the fingers are movably secured to the frame, and wherein a distance between the fingers in a first direction perpendicular to a length of the bow can be adjusted by moving at least one of the fingers with respect to the frame in the first direction, whereby a spacing between the portions of the at least one bow limb end in the first direction can be accommodated by adjusting the distance between the fingers.

5. The bow press of claim 4, wherein the finger assembly comprises:

a base secured to the frame; and a pin affixed to the base and extending in the first direction, and wherein the at least one finger includes a hole for insertion over the pin, and wherein the adjusting of the distance between the fingers is performed by sliding the at least one finger along the length of the pin.

6. The bow press of claim 1, wherein the finger assembly comprises:

a base secured to the frame; and a pin affixed to the base and extending in a first direction perpendicular to the length of the archery bow when the bow is mounted in the bow press, and wherein the at least one finger includes a hole for insertion over the pin, whereby the at least one finger is rotatably secured to the finger assembly, whereby the at least one finger can be adjusted by rotating the at least one finger to adjust a displacement between the first point of contact and the second point of contact.

7. The bow press of claim 6, further comprising an adjustment screw contacting the at least one finger and the base, whereby an initial angle of rotation of the at least one finger can be adjusted to adjust the displacement.

8. The bow press of claim 7, further comprising a spring contacting the at least one finger and the base, wherein the spring is compressed when the at least one finger is rotated away from contact with the adjustment screw, whereby a fixed rotational position of the at least one finger is maintained according to an adjustment position of the adjustment screw.

9. A method of servicing an archery bow, comprising:

compressing said bow by applying force from a mechanical bow press only at bow limb ends of said bow, wherein the limb ends of the bow include at least one limb end that is split into two portions, wherein said force is applied from fingers of an adaptable finger assembly mechanically coupled to a frame, wherein the fingers comprise a pair of fingers for contacting the split portions of the limb ends of the bow to apply the force;

prior to performing the compressing, adapting the fingers to at least one of a shape of a structure at the at least one limb end, a width between the two portions of the at least one limb end or a length of the portions of the at least one limb end.

10. The method of claim 9, wherein the adapting comprises:

removing a first interchangeable finger having a first shape from the frame; and securing second interchangeable finger having a different shape to the frame in place of the first finger, whereby interference with a shape of a structure proximate to the at least one bow limb end is be avoided.

11. The method of claim 10, wherein the removing comprises sliding the first interchangeable finger off of a pin affixed to a base mounted to the frame, wherein the pin extends in a first direction perpendicular to the length of the archery bow when the bow is mounted in the bow press, and wherein the securing comprises sliding the second interchangeable finger onto the pin.

12. The method of claim 9, wherein the fingers are movably secured to the frame, and wherein the adapting comprises adjusting a distance between the fingers in a first direction perpendicular to a length of the bow by moving at least one of the fingers with respect to the frame in the first direction, whereby a spacing between the portions of the at least one bow limb end in the first direction are accommodated by the adjusting.

13. The method of claim 12, wherein the adjusting comprises sliding the at least one of the pair of fingers along a pin affixed to a base mounted to the frame, wherein the pin extends in a first direction perpendicular to the length of the archery bow when the bow is mounted in the bow press.

14. The method of claim 9, wherein the portions of the at least one bow limb end have differing extensions in a second direction along the length of the archery bow when the archery bow is mounted in the bow press, and wherein the adapting comprises adjusting at least one of the pair of fingers to accommodate a distance between ends of the differing extensions, such that a first point of contact of a first one of the fingers with an end of a first one of the portions of the at least one bow limb is displaced by the distance in the second direction with respect to a second point of contact between a second one of the portions of the at least one bow limb end and a second one of the fingers.

15. The method of claim 14, wherein the adjusting is performed by rotating the at least one finger to adjust a displacement between the first point of contact and the second point of contact.

16. The method of claim 15, wherein the adjusting is controlled by an adjustment screw contacting the at least one finger and the base, whereby an initial angle of rotation of the at least one finger can be adjusted to adjust the displacement.

17. The method of claim 16, further comprising providing an opposing force to the adjusting from a spring contacting the at least one finger and the base, wherein the spring is compressed when the at least one finger is rotated away from contact with the adjustment screw, whereby a fixed rotational position of the at least one finger is maintained according to an adjustment position of the adjustment screw.

18. A bow press for servicing a compound archery bow, the bow press comprising:

a pair of fixtures including fingers for securing bow limb ends of the bow, and providing the sole points of application of force for compressing the bow when the bow is mounted in the bow press, wherein the limb ends of the bow include at least one limb end that is split into two portions, and wherein the fingers corresponding to the at least one limb end contact the split portions of the limb ends of the bow to apply the force, wherein the corresponding fingers are adaptable to at least one of a shape of a structure at the at least one limb end, a width between the two portions of the at least one limb end or a length of the portions of the at least one limb end; and a bench-top or floor mountable mechanism located outside of volume occupied by the bow when the bow is mounted in the bow press for servicing, the mechanism for compressing the bow by moving at least one of the pair of fixtures to increase a sole compressive force that compresses the bow for performing the servicing, and wherein the mechanism is located outside of a primary convex curvature of the bow both within the bow and as projected beyond the bow limb ends, whereby the mechanism does not interfere with access to a bow string of the bow for servicing.

19. The bow press of claim 18, wherein the mechanism comprises a retractable frame member mechanically secured to the pair of fixtures, and wherein a retraction of the frame member provides the sole compressive force, and wherein, wherein the retractable frame member is a telescoping frame member formed from two frame member portions, with one of the frame member portions slidably inserted in the other one of the frame member portions.

20. A bow press for servicing an archery bow, comprising:

a frame for securing the archery bow;

an adjustment mechanism for applying force to the limb ends of the bow to compress the bow, wherein the limb ends of the bow include at least one limb end that is split into two portions; and an adaptable finger assembly mechanically coupled to the frame and including a pair of fingers for contacting the split portions of the limb ends of the bow to apply the force, wherein the fingers are adaptable to at least one of a shape of a structure at the at least one limb end, a width between the two portions of the at least one limb end or a length of the portions of the at least one limb end, wherein the fingers include at least one finger that is removable and interchangeable as between a set of limb end fingers having a different shape, whereby interference with the shape of the structure can be avoided by securing a particular one of the set of limb end fingers to the finger assembly.

21. The bow press of claim 20, wherein the finger assembly comprises:

a base secured to the frame; and a pin affixed to the base and extending in a first direction perpendicular to the length of the archery bow when the bow is mounted in the bow press, and wherein the at least one finger includes a hole for insertion over the pin, whereby the at least one finger is rotatably secured to the finger assembly.

22. A bow press for servicing an archery bow, comprising:

a frame for securing the archery bow;

an adjustment mechanism for applying force to the limb ends of the bow to compress the bow, wherein the limb ends of the bow include at least one limb end that is split into two portions; and an adaptable finger assembly mechanically coupled to the frame and including a pair of fingers for contacting the split portions of the limb ends of the bow to apply the force, wherein the fingers are adaptable to at least one of a shape of a structure at the at least one limb end, a width between the two portions of the at least one limb end or a length of the portions of the at least one limb end, and wherein the finger assembly comprises a base secured to the frame, and a pin affixed to the base and extending in the first direction, and wherein the at least one finger includes a hole for insertion over the pin, and wherein the adjusting of the distance between the fingers is performed by sliding the at least one finger along the length of the pin.

* * * * *